US010004288B2

(12) United States Patent
Burri

(10) Patent No.: US 10,004,288 B2
(45) Date of Patent: Jun. 26, 2018

(54) APPAREL BELT AND BUCKLE APPARATUS

(71) Applicant: BSR Goldsmith, LLC, Santa Fe, NM (US)

(72) Inventor: Bernhard Burri, Santa Fe, NM (US)

(73) Assignee: BSR Goldsmith, LLC, Santa Fe, NM (US)

( * ) Notice: Subject to any disclaimer, the term of this patent is extended or adjusted under 35 U.S.C. 154(b) by 97 days.

(21) Appl. No.: 15/012,581

(22) Filed: Feb. 1, 2016

(65) Prior Publication Data

US 2016/0227859 A1 Aug. 11, 2016

Related U.S. Application Data

(60) Provisional application No. 62/112,595, filed on Feb. 5, 2015.

(51) Int. Cl.

| | |
|---|---|
| ***A41F 9/02*** | (2006.01) |
| ***A41F 9/00*** | (2006.01) |
| ***A44B 11/00*** | (2006.01) |
| ***A44B 11/22*** | (2006.01) |

(52) U.S. Cl.

CPC ..... *A41F 9/002* (2013.01); *A44B 11/001* (2013.01); *A44B 11/008* (2013.01); *A44B 11/223* (2013.01)

(58) Field of Classification Search

CPC ..... A41F 9/002; A41F 9/00; A44B 11/2549; A44B 11/006; A44B 11/24; A44B 11/25; A44B 11/2511; A44B 11/2561; A44B 11/28; A44B 11/008; A44B 11/2526; A45F 2003/045; A45F 3/005; A45F 3/047; A45F 3/14

See application file for complete search history.

(56) References Cited

U.S. PATENT DOCUMENTS

| | | | | |
|---|---|---|---|---|
| 630,045 | A | 8/1899 | Gaisman | |
| 695,940 | A | 3/1902 | Lowry | |
| 718,327 | A | 1/1903 | Distelman | |
| 941,136 | A | 11/1909 | Dubois | |
| 2,681,453 | A * | 6/1954 | Lane | A41F 9/002 2/322 |

(Continued)

FOREIGN PATENT DOCUMENTS

| | | |
|---|---|---|
| CN | 2647092 | 10/2004 |
| CN | 203194641 | 9/2013 |

(Continued)

OTHER PUBLICATIONS

International Search Report and Written Opinion of the ISA in co-owned PCT Pat. App. US16/16006, dated Apr. 19, 2016, 8 pages.

(Continued)

*Primary Examiner* — Bobby Muromoto, Jr.

(74) *Attorney, Agent, or Firm* — Trenner Law Firm, LLC; Mark D. Trenner

(57) ABSTRACT

In an example, a belt has a first end and a second end. A buckle with connectors and a slider is attached to one of the two ends of the belt. The buckle removably attaches to another of the two ends of the belt. A belt overlap extends through both sides of the buckle to cover openings or holes formed in at least one of the first end and the second end of the belt. The belt and buckle apparatus provides a balanced or symmetrical appearance even when it is worn by a user.

20 Claims, 15 Drawing Sheets

(56) References Cited

U.S. PATENT DOCUMENTS 2,885,685 A * 5/1959 Carr ..... A41F 9/002 2/321
3,103,047 A * 9/1963 Wolf, Jr. ..... A44B 11/25 24/165
3,760,467 A * 9/1973 Lohr ..... A44B 11/2526 24/639
5,283,933 A * 2/1994 Wiseman ..... A44B 11/2511 24/579.11
5,765,265 A * 6/1998 Kang ..... A44B 11/24 24/177
5,813,097 A * 9/1998 Woellert ..... A44B 11/2511 24/587.12
6,038,747 A * 3/2000 Hamilton ..... A44B 11/006 224/257
6,678,898 B2 * 1/2004 Jones ..... A41F 1/002 2/321
7,159,285 B2 * 1/2007 Karlsson ..... A44B 11/2549 24/579.11
2010/0071116 A1 * 3/2010 Burch ..... A44B 11/008 2/321

FOREIGN PATENT DOCUMENTS

KR 2013/0000903 2/2013
WO WO2014011104 1/2014

OTHER PUBLICATIONS

Machine Translation of KR 2013/0000903, 11 pages.
http://www.westernleatherholster.com/western-leather-belts-custom-gunbelts-cowboy-pouches/.
http://www.esafetysupplies.com/Miller-Body-Belt-with-2-Hip-D-Rings-and-Tongue-Buckle.html.
International Preliminary Report of Patentability for PCT/US2016/016005, dated Apr. 19, 2016, 7 pages.

* cited by examiner

APPAREL BELT AND BUCKLE APPARATUS

PRIORITY CLAIM

This application claims the priority benefit of U.S. Provisional Patent Application No. 62/112,595 filed Feb. 5, 2015 for "Apparel Dress Belt And Buckle Apparatus" of Bernhard Burri, hereby incorporated by reference in its entirety as though fully set forth herein.

BACKGROUND

Belts have commonly been made of leather or like material and are worn about the waist to support pants or other articles of clothing. Belts have been in use in some parts of the world as early as 3,000 B.C., and one of the more recent major improvements to apparel belt buckles was the D-shape buckle approximately 2,000 years ago. In addition to a utilitarian purpose, belts may also be decorative and/or worn according to current fashion.

The typical belt has several layers on one side and only one layer on the other side, giving an imbalanced or crooked appearance. For example, a typical belt has a fold for the buckle (e.g., resulting in two layers) and then the overlapping portion of the belt (e.g., resulting in an additional layer); while the other side has only one layer. This also gives the belt a crooked, unsymmetrical appearance.

While some belts attempt to present an overall balanced appearance, such belts have been unpractical in use. For example, these belts often require length adjustment prior to wearing and/or during wearing of the belt. Other belts are too complicated to actually use due to too the many adjustable parts that have to be aligned and adjusted.

In addition, most of these belts still have visible holes in the belt. Holes in the belt are unattractive and tend to wear out over time, making these holes and the belt as a whole even less attractive.

DETAILED DESCRIPTION

Figure 1A:
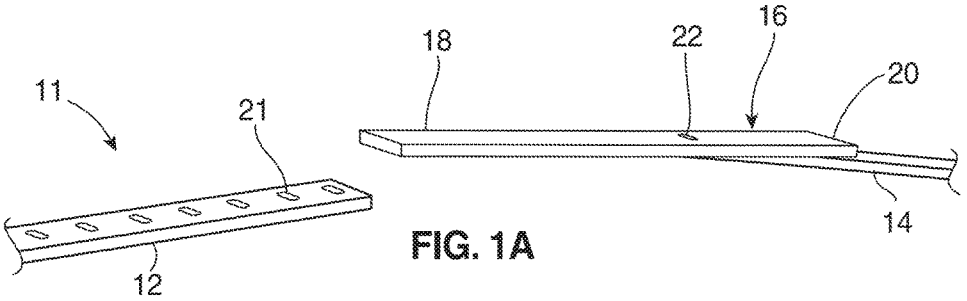
FIGS. 1A-C show an example apparel belt and buckle apparatus referred to as a Standard Belt (Overlap attached to Right Belt End) configuration.

An apparel belt and buckle apparatus is disclosed herein as it may be used for a waist belt, a head band, or any other apparel belt or strap. An example belt and buckle apparatus includes a belt having a first end and a second end. A buckle is attached to either one of the two ends of the belt. The buckle and slider removably attaches to another of the two ends of the belt. A belt overlap extends through both sides of the buckle to cover openings or holes formed in at least one of the first end and the second end of the belt. The belt and buckle apparatus provides a balanced and/or symmetrical appearance even when it is worn by a user.

In an example, the apparel belt and buckle apparatus may include a distinctive belt with holes formed on one or both ends of a belt strap for one or more slider to attach, to adjust the length of the belt around a waist of a person wearing the belt. In an example having holes on only one side of the belt strap (e.g., for length adjustment), the belt may have a single hole or several holes formed on the other end to hook the buckle tongue into for closing the belt assembly or to add and adjust a slider.

A belt overlap may also be attached to one of the belt ends. In an example, the belt overlap can also be connected to the buckle in full or in half, and is one of the core components of the concept. The slider(s) enable adjustment of the belt length by sliding along the belt end without changing dimensions in the front of the belt, maintaining a balance and/or symmetrical appearance. Adjustable keepers may be adjusted according to the adjustment of the belt length.

The apparel belt and buckle apparatus is easy to adjust in length and as easy to use as a traditional apparel belt. The apparel belt and buckle apparatus is structurally different from other known devices, for example, due at least in part to the distinctive belt, the belt overlap, the slider(s), and the adjustable keepers.

It is noted that the belt and buckle apparatus with a balanced and symmetrical appearance, as disclosed herein, provides a basic concept for creating further belt and buckle designs. In addition, the example belt and buckle apparatus may include decorative components, such as but not limited to, metal ornaments, Conchos, stone, inlay mountings/sections, and/or any other decorative element and/or any combination or variation in any material or design thereof.

In addition, any of the components described herein can be manufactured of any suitable materials, such as but not limited to, metals, precious metals, leather, fabric, wood, plastic, composite materials, fiber glass, carbon fiber. The components can be designed to have any desired design, style, look and appearance, combination, and/or variation thereof.

Before continuing, it is noted that as used herein, the terms "includes" and "including" mean, but is not limited to, "includes" or "including" and "includes at least" or "including at least." The term "based on" means "based on" and "based at least in part on." In addition, fashion terms such as "existing," "standard," and "classic" or "classical" refer to various styles and are not an admission of prior art.

Figure 1B:
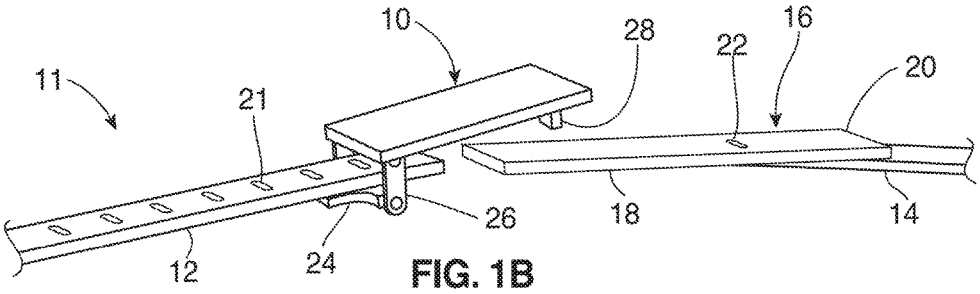
Figure 1C:
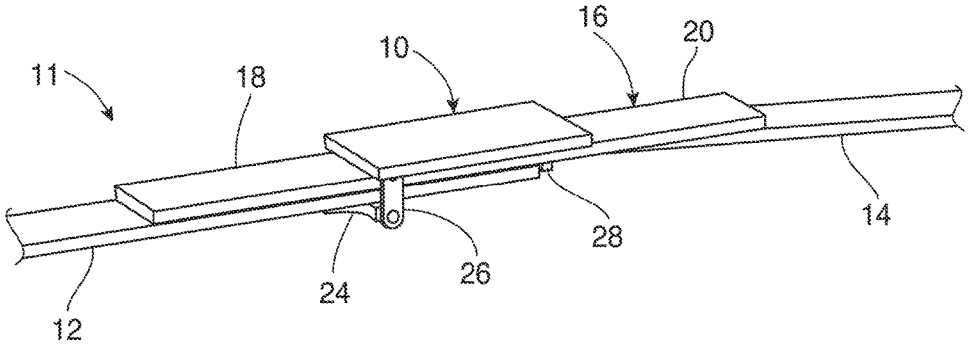

FIGS. 1A-C show an example apparel belt and buckle apparatus referred to herein as a Standard Belt configuration. In an example, the apparel belt and buckle apparatus includes a belt 11 having a first end 12 and a second end 14. A buckle 10 with slider 24 is attached to one of the two ends 12 or 14 of the belt 11. The buckle 10 with slider 24 may be removably attached to another of the two ends 12 or 14 of the belt 11. A belt overlap 16 has a first side 18 and a second side 20 and is attached to one end of the belt (e.g., belt end 14).

During fastening, the belt overlap 16 extends through the buckle 10 so that at least one of the first side 18 and the second side 20 cover openings 21 and/or 22 (e.g., openings formed in at least one of the first end 12 and the second end 14 of the belt 11). The belt overlap 16 (along with buckle 10) provides a balanced or symmetrical appearance (e.g., as shown in FIG. 1C).

In an example, the apparel belt and buckle apparatus includes a slider 24 on the buckle 10. In an example, the slider 24 is linked to the buckle by connectors 26. In this example, connectors 26 are provided on each side (although the back side connector is not readily visible in FIGS. 1A-C). The slider 24 engages one of the openings 21 formed in the first end 12 of the belt 11 to adjustably attach the buckle 10 to the first end 12 of the belt 11, as will be discussed in more detail below.

In an example, the apparel belt and buckle apparatus includes a tongue 28 on the buckle 10. The tongue 28 engages one of the openings 22 formed in the second end 14 of the belt 11. The tongue is operable to adjustably attach the buckle 10 to the second end 14 of the belt 11.

Before continuing, it should be noted that the examples described above are provided for purposes of illustration, and are not intended to be limiting. Other devices and/or device configurations may be utilized to carry out the operations described herein. By way of example, the overlap may be attached to either the right or left belt end. Further examples include, but are not limited to, any variation or combination of the components described herein, or variations of any of these components and materials in any manner of assembly and/or configuration.

Figure 2A:
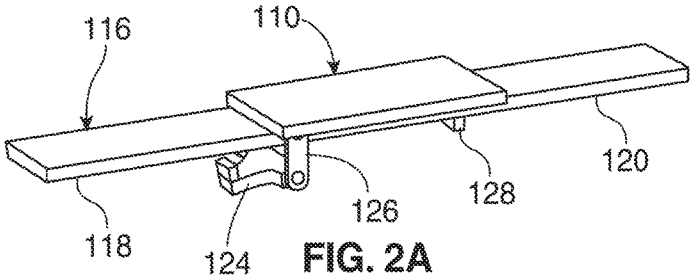
FIGS. 2A-C show an example apparel belt and buckle apparatus referred to as a Complete Overlap attached to Buckle configuration.
Figure 2B:
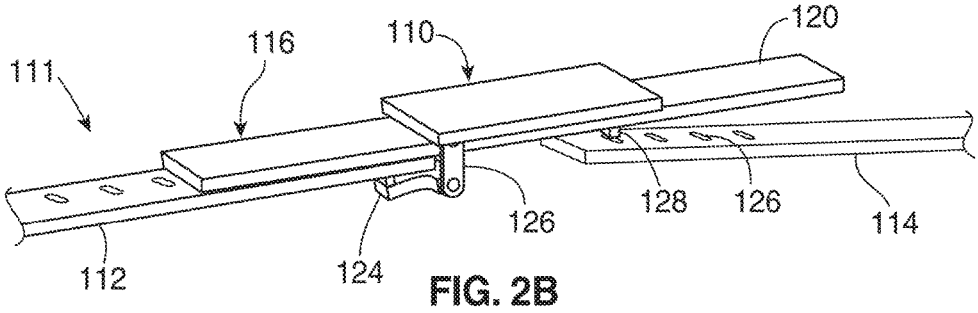
Figure 2C:
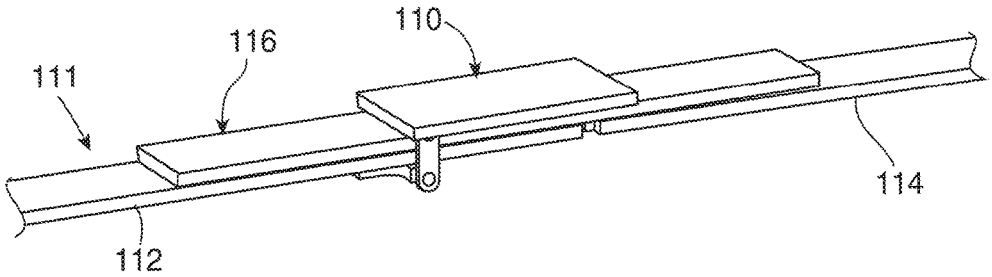

FIGS. 2A-C show an example apparel belt and buckle apparatus referred to herein as a Complete Overlap attached to Buckle configuration. In FIGS. 2A-C, 100-series reference numbers designate similar components already described above for FIGS. 1A-C.

In this example, the belt overlap 116 extends through and is connected to the buckle 110. The buckle 110 may be attached via the slider 124 and tongue 128 as already described above to provide substantially the same appearance as the Standard Belt configuration (e.g., as shown in FIG. 2C).

Figure 3A:
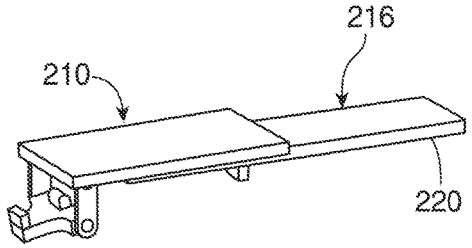
FIGS. 3A-C show an example apparel belt and buckle apparatus referred to as a Right End Overlap attached to Buckle configuration.
Figure 3B:
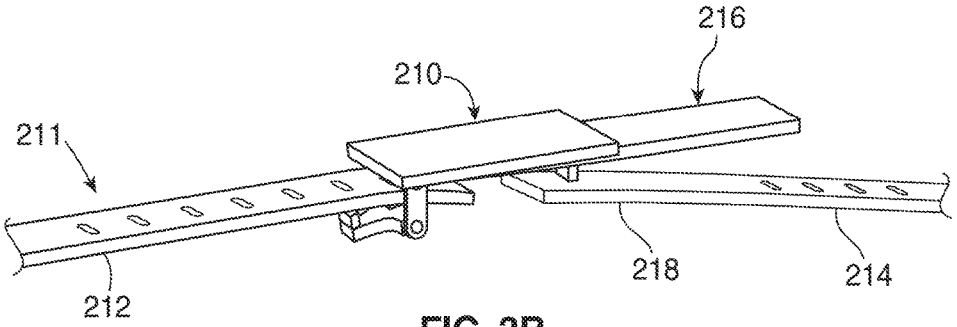
Figure 3C:
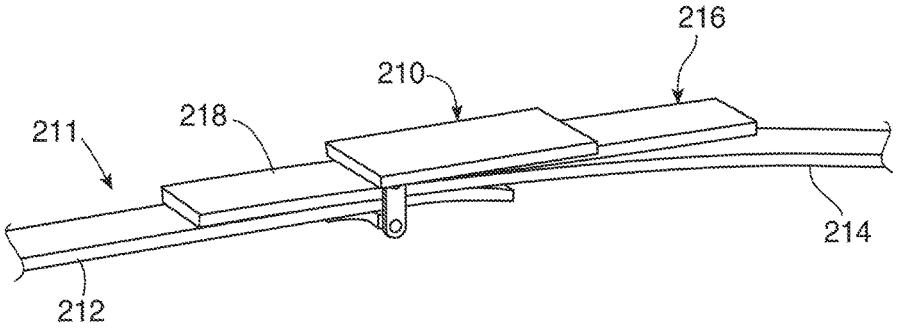

FIGS. 3A-C show an example apparel belt and buckle apparatus referred to herein as a Right End Overlap attached to Buckle configuration. In FIGS. 3A-C, 200-series reference numbers designate similar components already described above for FIGS. 1A-C.

In this example, the belt overlap 216 is connected to the buckle 210 and extends out only one side (e.g., the right side in this illustration) of the buckle 210. The belt end 214 extends out the opposite side (e.g., the left side in this illustration) of the buckle 210. The buckle 210 may be attached via the slider 224 and tongue 228 as already described above to provide substantially the same appearance as the Standard Belt configuration (e.g., as shown in FIG. 3C).

Figure 4A:
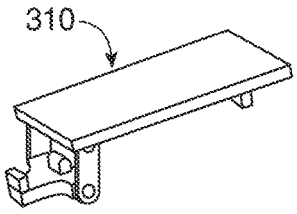
FIGS. 4A-C show an example apparel belt and buckle apparatus referred to as a Western Buckle configuration.
Figure 4B:
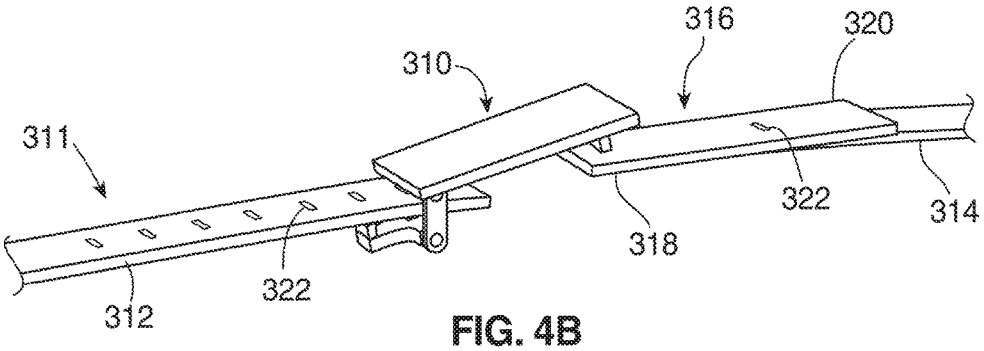
Figure 4C:
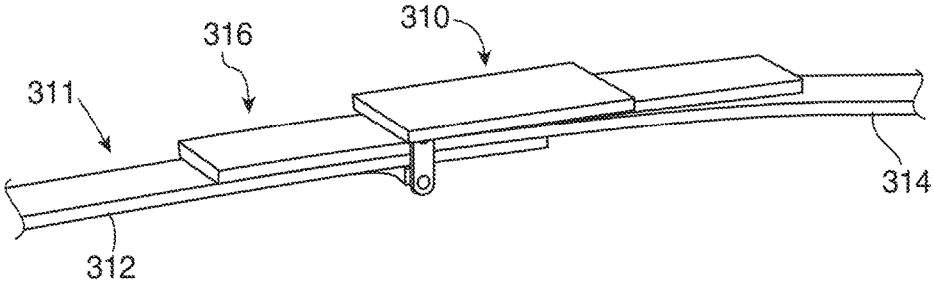

FIGS. 4A-C show an example apparel belt and buckle apparatus referred to herein as a Western Buckle configuration. In FIGS. 4A-C, 300-series reference numbers designate similar components already described above for FIGS. 1A-C.

In this example, the belt overlap 316 is connected to the belt end 314. As such, the overlap 316 extends through the buckle 310 automatically when the belt is fastened. The buckle 310 may be attached via the slider 324 and tongue 328 as already described above to provide substantially the same appearance as the Standard Belt configuration (e.g., as shown in FIG. 4C).

Figure 5A:
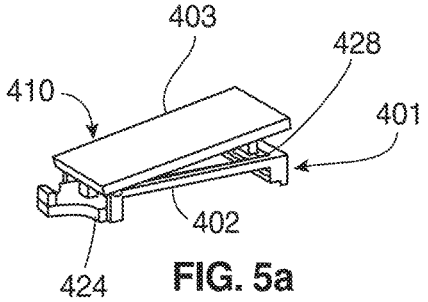
FIGS. 5A-C show an example apparel belt and buckle apparatus referred to as a Business Clip Buckle configuration.
Figure 5B:
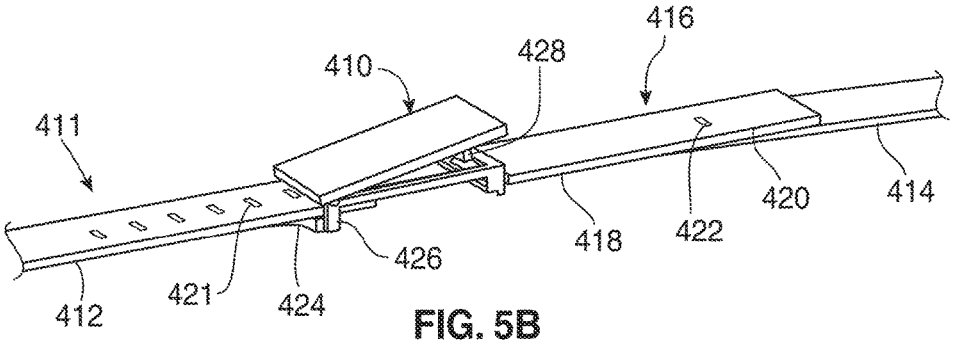
Figure 5C:
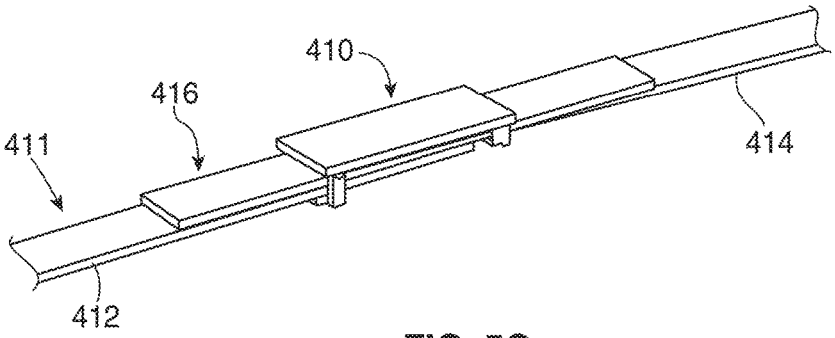

FIGS. 5A-C show an example apparel belt and buckle apparatus referred to herein as a Business Clip Buckle configuration. In FIGS. 5A-C, 400-series reference numbers designate similar components already described above for FIGS. 1A-C.

In this example, the buckle 410 includes a rectangular opening 401 on frame 402 to receive the belt overlap 416. A top plate 403 may also be provided and is operable to cover the frame 402 and to lock the other belt end into the buckle.

In this example, the belt overlap 416 is again connected to the belt end 414. The overlap 416 extends through the buckle 110 automatically when the belt is fastened. The buckle 410 may be attached via the slider 424 and tongue 428 as already described above to provide substantially the same appearance as the Standard Belt configuration (e.g., as shown in FIG. 5C).

Figure 6A:
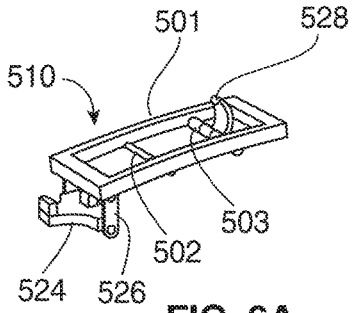
FIGS. 6A-C show an example apparel belt and buckle apparatus referred to as a Classic Tongue Buckle configuration.
Figure 6B:
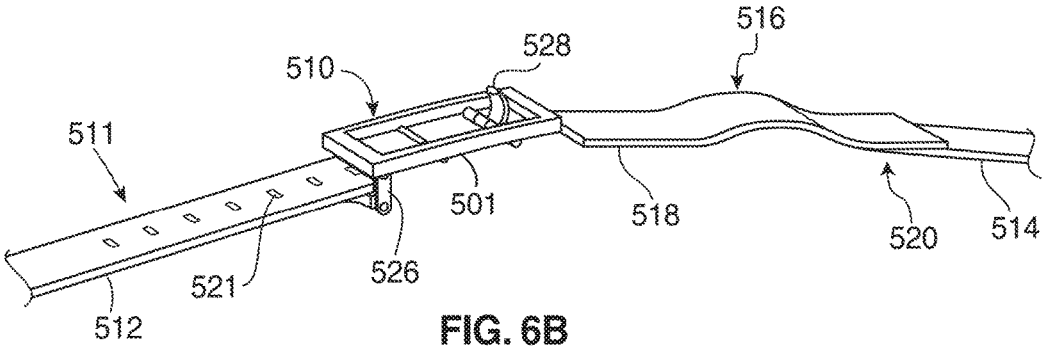
Figure 6C:
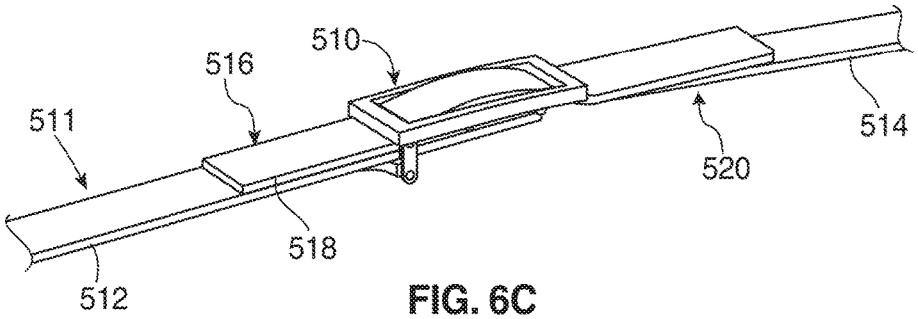

FIGS. 6A-C show an example apparel belt and buckle apparatus referred to herein as a Classic Tongue Buckle configuration. In FIGS. 6A-C, 500-series reference numbers designate similar components already described above for FIGS. 1A-C.

In this example, the buckle 510 includes a frame 501 and guide posts 502 and 503 on the frame 501, and a reverse tongue 528 on post 503. Post 503 may be rotatable to move tongue 528 into position to engage with the opening indicated by arrow 522. The belt overlap 516 is attached to the belt end 514 and has openings 522 underneath to receive the reverse tongue 528.

In this example, the belt overlap 516 is again connected to the belt end 514. The overlap 516 extends through the buckle 510 automatically when the belt is fastened. The buckle 510 may be attached via the slider 524 and tongue 528 to provide the desired appearance (e.g., as shown in FIG. 6C).

Figure 7A:
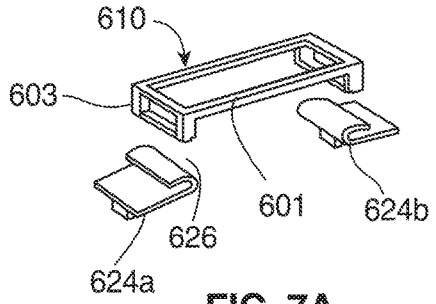
FIGS. 7A-C show an example apparel belt and buckle apparatus referred to as a Double Hook Buckle configuration.
Figure 7B:
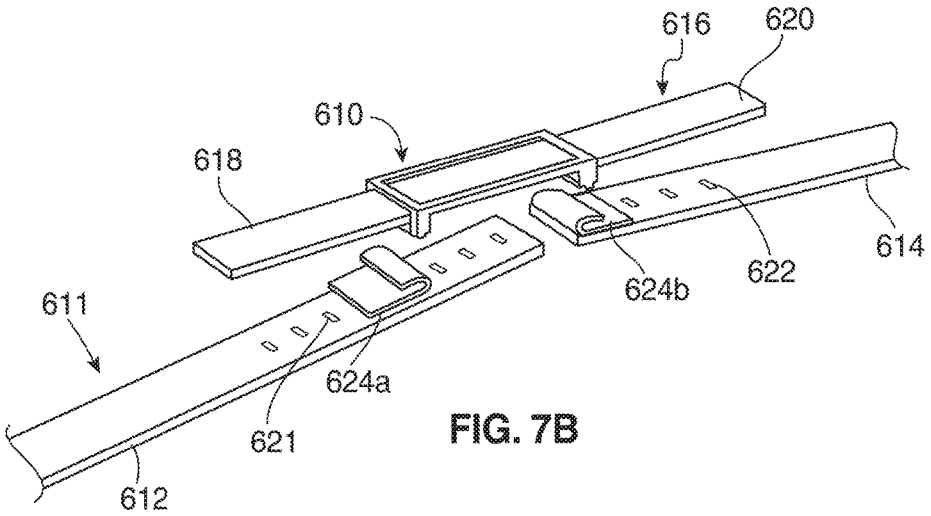
Figure 7C:
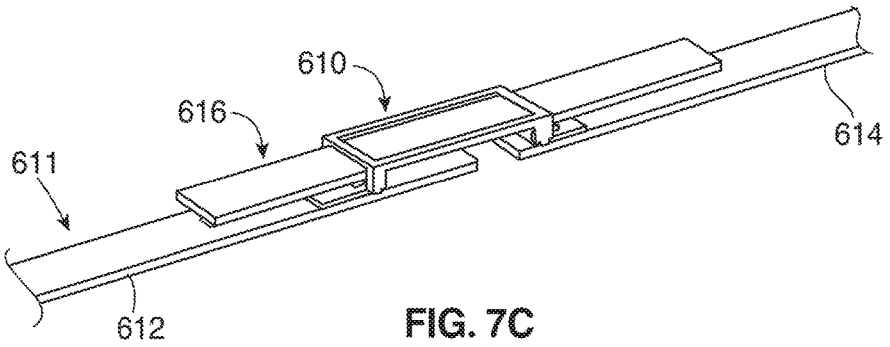

FIGS. 7A-C show an example apparel belt and buckle apparatus referred to herein as a Double Hook Buckle configuration. In FIGS. 7A-C, 600-series reference numbers designate similar components already described above for FIGS. 1A-C.

In this example, the buckle 610 includes a frame 601 with openings 602 and 603. In an example, the buckle 310 does not include a tongue. Instead, the buckle 610 includes two sliders 624*a* and 624*b*. The belt overlap 616 is provided separately through the buckle 610. Sliders 624*a* and 624*b* engage sliders openings 603 and 602, respectively to fasten the belt and to provide substantially the same appearance as the Standard Belt configuration (e.g., as shown in FIG. 7C). As such, each of two opposite sides of the buckle attach to the first end and the second end of the belt with separate sliders.

Figure 8A:
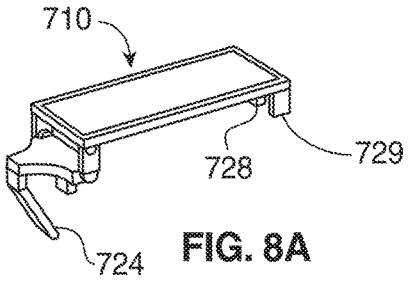
FIGS. 8A-C show an example apparel belt and buckle apparatus referred to as an Invisible Buckle configuration.
Figure 8B:
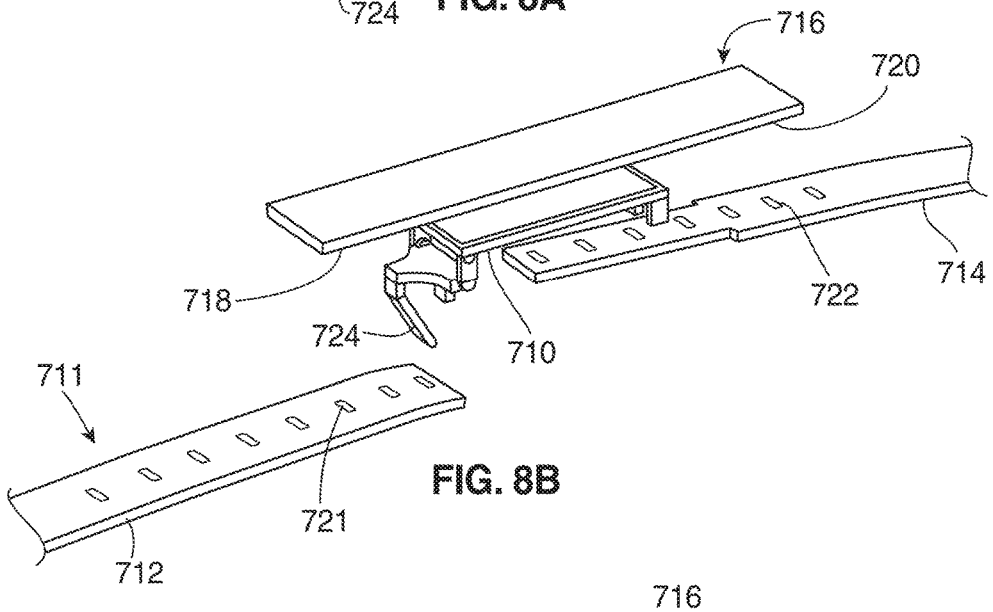
Figure 8C:
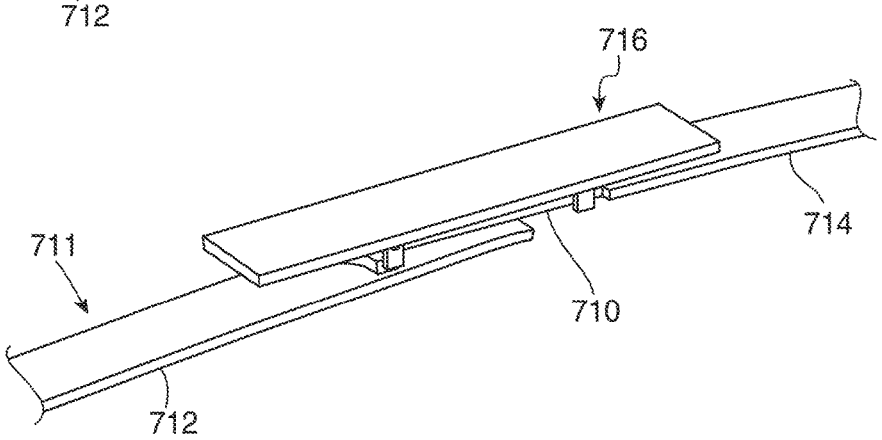

FIGS. 8A-C show an example apparel belt and buckle apparatus referred to herein as an Invisible Buckle configuration. In FIGS. 8A-C, 700-series reference numbers designate similar components already described above for FIGS. 1A-C. As used herein, the term "invisible" means that the buckle is not readily visible when the belt is assembled or worn by a user, as shown in FIG. 8C.

In this example, the buckle 510 may include a hinged slider 524 which folds flat after insertion through one of the openings 21 in the belt. The tongue 728 may also be aligned by frame cheeks 529 (another frame cheek on the other side of the tongue 528 is also provided, although not visible in FIG. 8). The belt overlap 716 is mounted on the buckle 710. The buckle 710 may be attached via the slider 724 and tongue 728 as already described above.

Figure 9A:
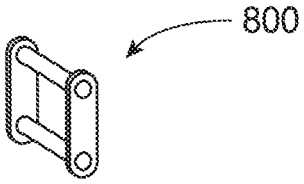
FIGS. 9A-C show example connectors for an apparel belt and buckle apparatus referred to as a Standard Connectors configuration.
Figure 9B:
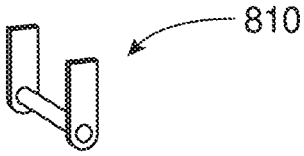
Figure 9C:
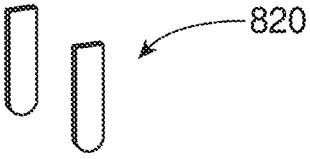

FIGS. 9A-C show example connectors for an apparel belt and buckle apparatus referred to herein as a Standard Connectors configuration. In FIG. 9A, connector 800 may be hinged to both the buckle (e.g., to buckle 10 on top) and to the slider (e.g., slider 24 on the bottom). In FIG. 9B, connector 810 may be fixed to the buckle (e.g., to buckle 10 on top) and hinged to the slider (e.g., slider 24 on the bottom). In FIG. 9C, connector 820 may be fixed to both the buckle (e.g., to buckle 10 on top) and fixed to the slider (e.g., slider 24 on the bottom).

Figure 10A:
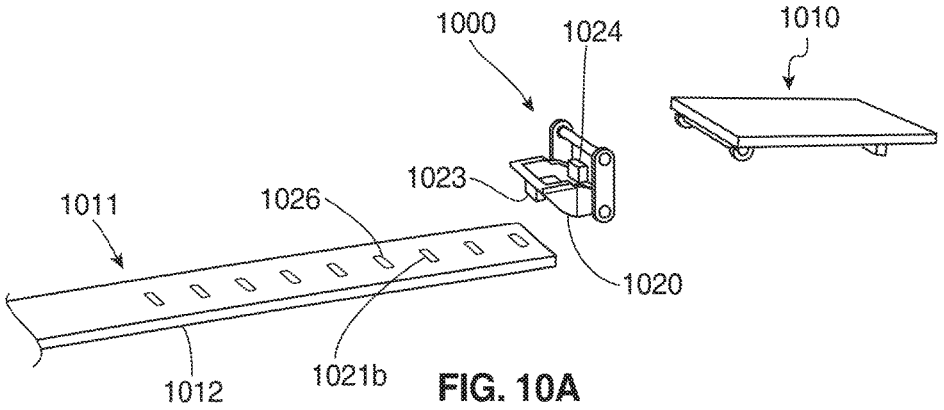
FIGS. 10A-B show an example slider for the apparel belt and buckle apparatus referred to as a Slider Hook in Scale configuration.
Figure 10B:
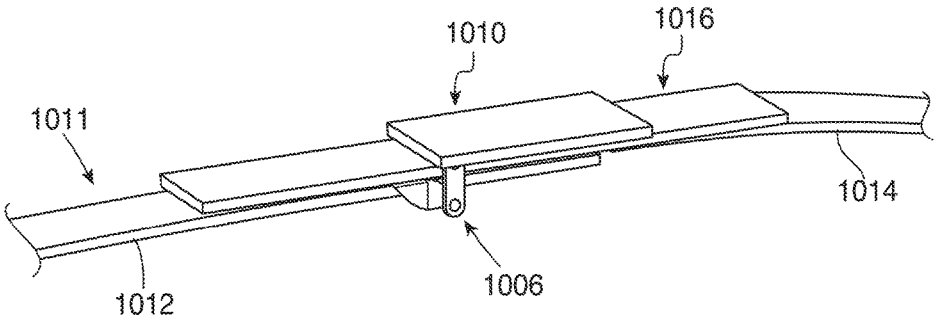

FIGS. 10A-B show an example slider for the apparel belt and buckle apparatus referred to herein as a Slider Hook in Scale configuration. In FIGS. 10A-B, 1000-series reference numbers designate similar components already described above for FIGS. 1A-C.

In FIG. 10, slider 1000 may be attached to buckle 1010. The slider 1000 is scoop shaped including guide walls 1020 for the belt on each side of the slider 1000. The slider 1000 also includes a first post 1023 to engage a first opening 1021*a* in belt end 1012 from above the belt 1011, and a second post 10242 to engage a second opening 1021*b* (e.g., an adjacent opening) in belt end 1012 from below the belt 1011.

Figure 11A:
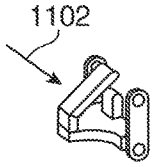
FIGS. 11A-C show an example slider for the apparel belt and buckle apparatus referred to as a Slider Hook in with Clip configuration.
Figure 11B:
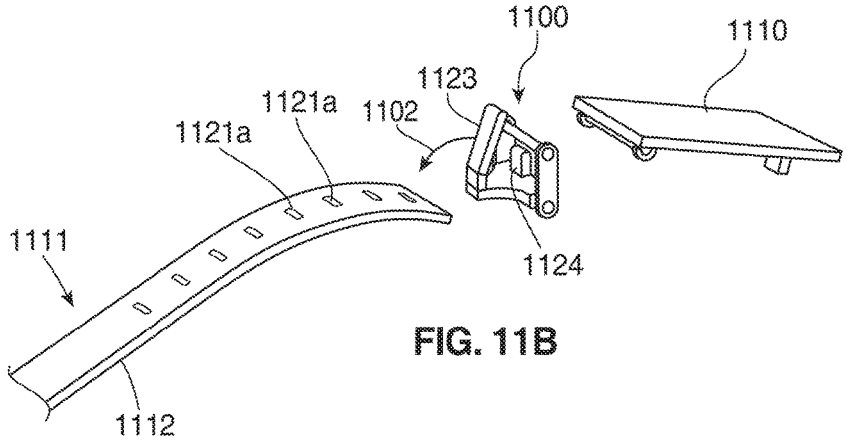
Figure 11C:
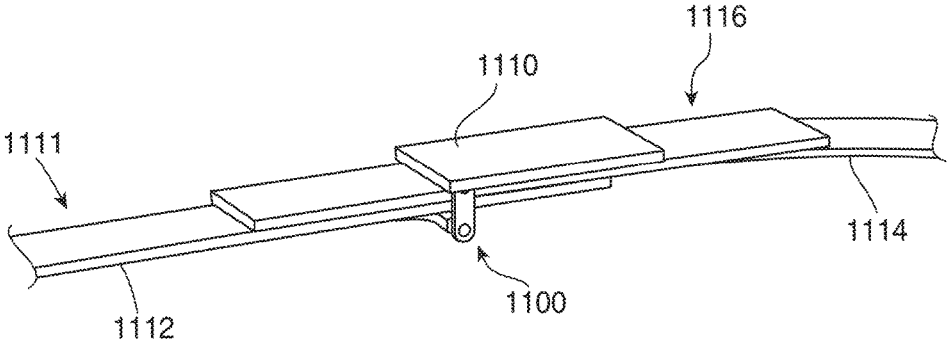

FIGS. 11A-C shows an example slider 1100 for the apparel belt and buckle apparatus referred to herein as a Slider Hook in with Clip configuration. In FIGS. 11A-C, 1100-series reference numbers designate similar components already described above for FIGS. 1A-C.

In this example, the buckle 1110 may include a hinged slider 1100 with pivotable hook 1123 as illustrated by arrows 1101 and 1102, which folds flat after insertion through one of the openings 1121 in the belt 1111. The slider 1100 includes pivotable hook 1123 to engage a first opening 1121*a* in belt end 1112 from above the belt 1111, and a second post 1124 to engage a second opening 1121*b* (e.g., an adjacent opening) in belt end 1112 from below the belt 1111. After connecting pivotable hook 1123 to opening 1121*a*, the pivotable hook 1123 may be laid flat, e.g., in the direction illustrated by arrow 1102.

Figure 12A:
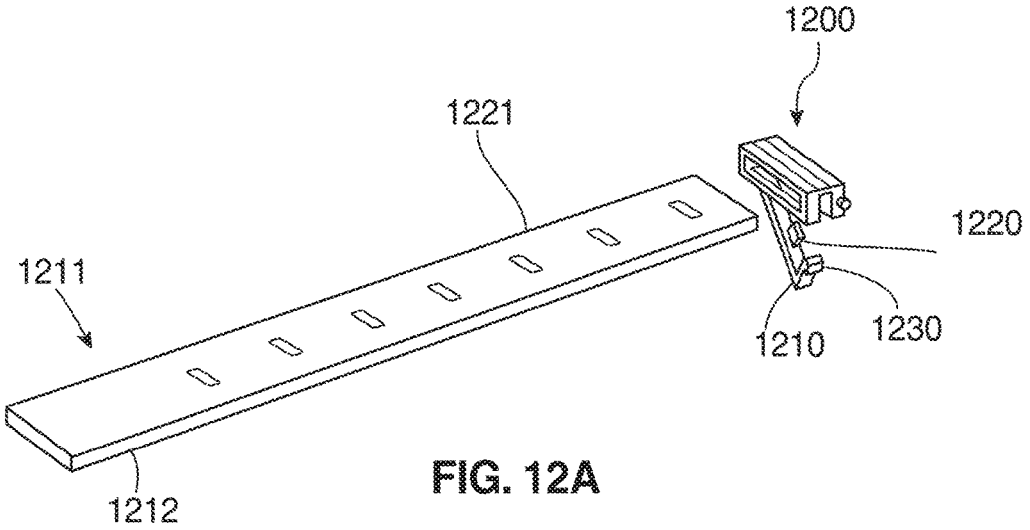
FIGS. 12A-B show an example slider for the apparel belt and buckle apparatus referred to as a Slider Standard Clip with Hinge Posts for Connectors configuration.
Figure 12B:
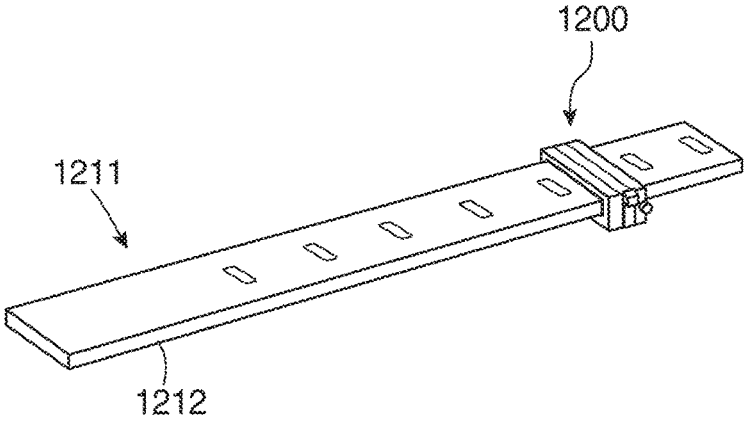

FIGS. 12A-B show an example slider 1200 for the apparel belt and buckle apparatus referred to herein as a Slider Standard Clip with Hinge Posts for Connectors configuration. The slider 1200 has a generally rectangular or "frame" configuration, with an arm 1210 having a post 1220. The slider 1200 may be slid into the desired position on belt end 1212 of the belt 1211, and the arm 1210 closed or clamped to engage the post 1220 in the opening 1221. Arm 1210 may have a snap closure 1230 to retain the arm 1210 in a closed or locked position, as shown FIG. 12B.

Figure 13A:
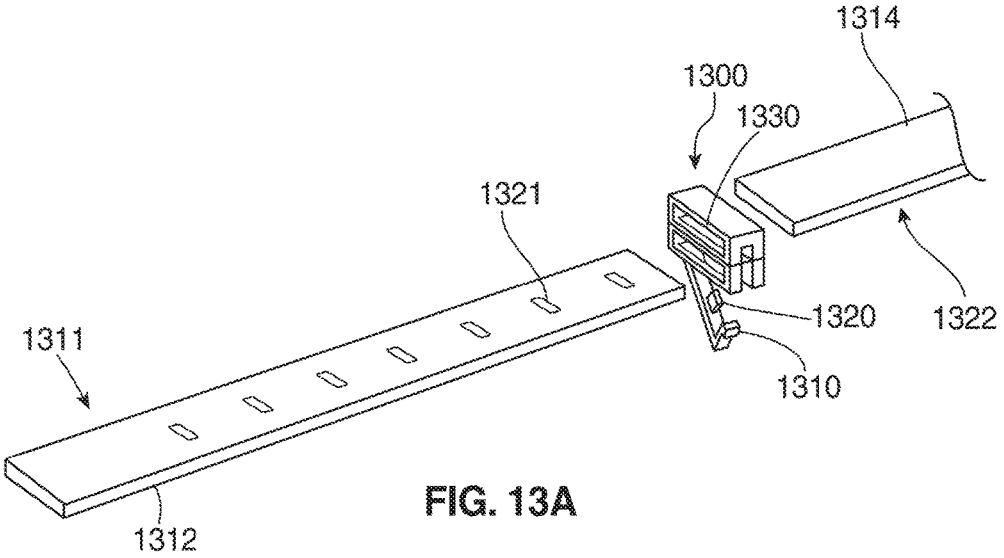
FIGS. 13A-B show an example adjustable keeper of the apparel belt and buckle apparatus referred to as a Standard Clip configuration.
Figure 13B:
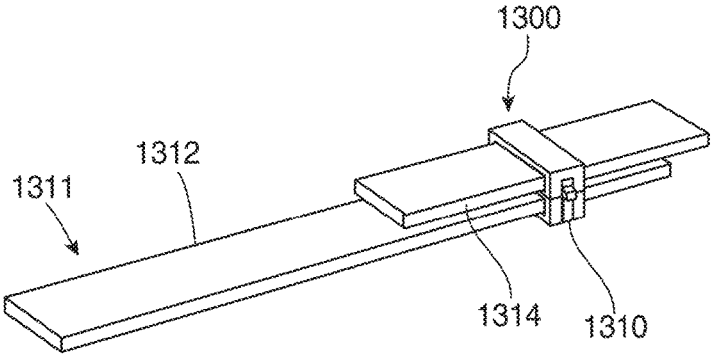

FIG. 13 shows an example adjustable keeper 1300 of the apparel belt and buckle apparatus referred to herein as a Standard Clip configuration. Keeper 1300 includes a slider portion 1301 having a generally rectangular or "frame" configuration, with an arm 1310 having a post 1320. In addition, keeper 1300 may include a keeper loop 1330 to receive the opposite belt end 1314.

The slider portion 1301 may be slid into the desired position on belt end 1312 of the belt 11, and the keeper loop 1330 may receive the other belt end 1314. When aligned with the desired openings 1321 and 1322 (formed underneath) in the respective belt ends 1312 and 1314, the arm 1310 may be closed or clamped to engage the post 1320 in both of the openings 1321 and 1322. Arm 1310 may have a snap closure 1330 to retain the arm 1310 in a closed or locked position, as shown at the bottom of FIG. 13.

Figure 14A:
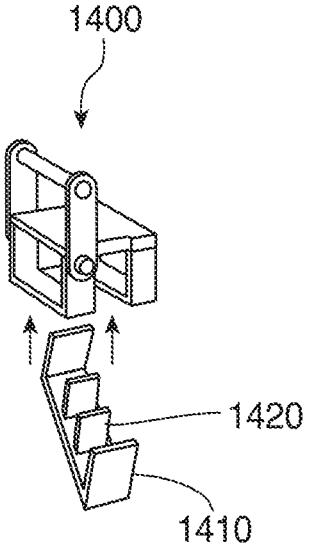
FIGS. 14A-B show an example slider for the apparel belt and buckle apparatus referred to as a Safety with Slider/Connector configuration.
Figure 14B:
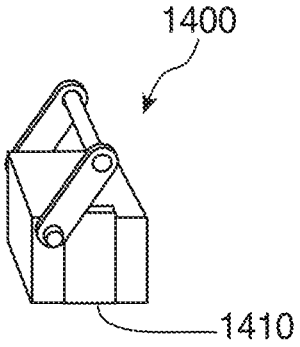

FIGS. 14A-B show an example slider 1400 for the apparel belt and buckle apparatus referred to herein as a Safety with Slider/Connector configuration. The slider 1400 has a generally rectangular or "frame" configuration, with a clip 1410 having a post 1420. The slider 1400 may be slid into the desired position on one of the belt ends (not shown), and the clip 1410 may be pressed or clamped to the frame of slider 1400 to engage the post 1420 in one of the openings in the belt. Clip 1410 may have a closure (e.g., a snap) to retain the clip 1410 in a closed or locked position, as shown at the bottom of FIG. 14. As soon as the belt is worn, the connector(s) cover the clip of the slider and provides a safety to maintain the clip in a locked position when the belt is worn. Slider 1400 may be attached to a buckle (e.g., buckle 10) as described for any of the above embodiments.

Figure 15A:
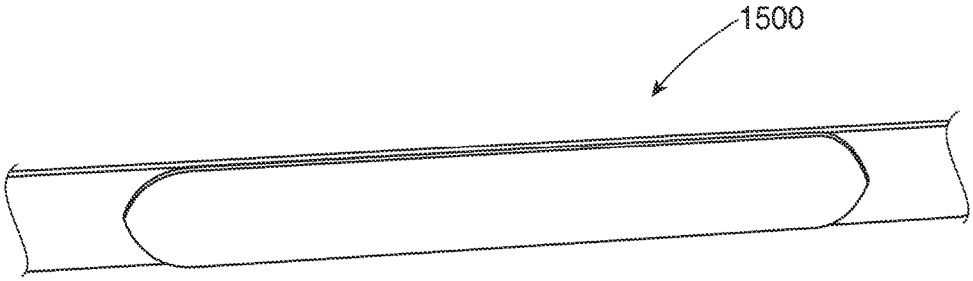
FIG. 15A shows an example of the apparel belt and buckle apparatus referred to as a Minimum Variation Invisible Buckle Leather Overlap configuration.
Figure 15B:
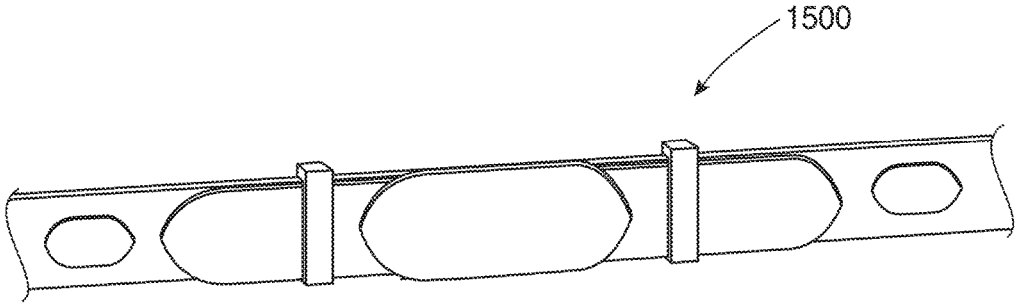
FIG. 15B shows an example of the apparel belt and buckle apparatus referred to as a Maximum Variation Buckle Keepers.

FIG. 15 shows an example of the apparel belt and buckle apparatus referred to herein as a Minimum Variation Invisible Buckle Leather Overlap configuration. FIG. 16 shows an example of the apparel belt and buckle apparatus referred to herein as a Maximum Variation Buckle Keepers. These and other configurations are contemplated as will be understood by those having ordinary skill in the art after becoming familiar with the teachings here in, to provide a balanced or symmetrical appearance.

It will also be understood that the belt overlap can be attached to the right or the left belt end by any means, including but not limited to stitching, gluing, snaps, hook-and-loop fastener, ratchet, etc. The belt overlap can also be fully attached to a buckle, or half attached to a buckle by means of but not limited to stitching, gluing, snaps, hook-and-loop fastener, ratchet, etc., or any other combination or variation in any material or design thereof. In an example, the belt overlap is attached to one or the other belt end (or attached to both belt ends).

In addition, the belt and buckle apparatus may include a buckle which is attached to connectors which attach to slider(s) which attach to an underlying main distinctive belt strap to fasten the distinctive belt by any means including, but not limited to hooking the buckle tongue into the hole on the belt overlap and belt end. In another example, the holes or openings can be covered and enforced for strength and durability with a sleeve. The buckle tongue may be made in any desired shape for example but not limited to round or flat.

The belt and buckle apparatus may include connectors which make the connection between the buckle and the slider. The connectors can be fixedly attached to the buckle and the slider, or hinged on either end (e.g., both ends moving), or any variation and combination thereof. In an example, the connectors connect the buckle with the slider in any suitable manner.

The belt and buckle apparatus may also include slider(s) in any variation, including but not limited to horizontal vertical, hooked-in, slide-in, clip design, or any variation thereof, to connect the slider(s) to the distinctive belt, connector, or buckle, such as but not limited to by clip, hook-and-loop fastener, snaps, screws, ratchet, etc. The slider(s) may be attached to the connectors which are attached to the buckle. The slider(s) may be operated to adjust length of belt by means of opening the slider clip to unlock the slider tongue from the belt, then move slider over the belt end and close it back into place in one or more of the belt openings on the main distinctive belt strap. In an example, the belt openings may be covered and enforced for strength and durability with a sleeve.

The belt and buckle apparatus may also include adjustable keepers to maintain balance and symmetry after a length of belt has been adjusted, which also maintains both ends of the belt overlap tight to the underlying distinctive belt. The keepers may be any variation, including but not limited to horizontal, vertical, hooked-in, slide-in, clip design, or any variation thereof, to connect the Keeper(s) to the distinctive belt, such as but not limited to by clip, hook-and-loop fastener, snaps, screws, ratchet, etc.

In an example, the adjustable keepers can be adjusted in placement on the belt by opening and closing the keeper clip in the desired belt opening. It may also include keepers in any variation, including but not limited to horizontal, vertical, screwed, etc. or any variation thereof.

The belt and buckle apparatus may also include tips to protect the end pieces of the belt overlap and to improve appearance/looks of the entire belt.

The belt and buckle apparatus may also include sleeves in any material or variation, to cover the belt openings to enforce strength and durability. In an example the sleeve with hook may secure the buckle tongue on to the opposite belt end. In an example, the sleeves reinforce the belt hole to prevent wearing on the hole as well as implementing the sleeve with hook for a more elegant way to close and connect the buckle tongue with the distinctive belt.

The belt and buckle apparatus may also include safety clips. Safety clips may secure the slider clip from accidental opening when the belt is worn. In an example, the safety clip is attached to the slider(s) and/or keeper(s) to ensure that these stay closed.

The belt and buckle apparatus may also include snaps. Snaps can be attached under the belt overlap and on top of belt end(s) to keep the belt overlap from flopping around (e.g., when keepers are not provided). In an example, the snaps are attached to the belt overlap underside and on top of the belt end(s) to secure the belt overlaps onto the belt ends to prevent these from flopping around loosely. In other examples, hooks, hook-and-loop or any other suitable fastener may be provided to achieve this result.

It is noted that the examples shown and described are provided for purposes of illustration and are not intended to be limiting. Still other examples are also contemplated.

The invention claimed is:

1. An apparel belt and buckle apparatus, comprising:

a belt having a first end and a second end, the belt defining a vertical axis through a front portion of the belt when the belt is closed for wearing;

a buckle adjustably attached to at least one of the two ends of the belt, the buckle removably attaching to another of the two ends of the belt;

a belt overlap having a first side and a second side, the belt overlap extending through the buckle so that both of the first side and the second side cover openings formed in at least one of the first end and the second end of the belt, the belt overlap is configured to provide a balanced or symmetrical appearance about the vertical axis with a right side free end and a left side free end of the overlap, and the belt overlap providing a second layer over a first layer of the belt on each side of the vertical axis.

2. The belt and buckle apparatus of claim 1, further comprising a slider on the buckle, the slider engaging at least one opening formed in the first end of the belt to adjustably attach the buckle to the first end of the belt, wherein the buckle removably connects to the second end of the belt.

3. The belt and buckle apparatus of claim 2, further comprising connectors to link the slider to the buckle.

4. The belt and buckle apparatus of claim 1, further comprising a tongue on the buckle, the tongue fixedly attached to the buckle, and the tongue engaging an opening formed in the second end of the belt to removably attach the buckle to the second end of the belt.

5. The belt and buckle apparatus of claim 1, wherein the buckle has a frame hinged to a top plate where the other belt end locks in place.

6. The belt and buckle apparatus of claim 1, wherein the buckle has an upside down oriented tongue.

7. The belt and buckle apparatus of claim 6, wherein the buckle has a tongue post rotatably connecting the upside down oriented tongue to the buckle.

8. The belt and buckle apparatus of claim 1, wherein each of two opposite sides of the buckle attach to the first end and the second end of the belt with separate sliders with hooks.

9. The belt and buckle apparatus of claim 1, further comprising a hinged slider clip.

10. The belt and buckle apparatus of claim 1, further comprising an adjustable keeper.

11. An apparel belt and buckle apparatus, comprising:

a belt having a first end and a second end, the belt defining a vertical axis through a front portion of the belt when worn by a person;

a buckle adjustably attached to one of the two ends of the belt, the buckle removably attaching to at least another of the two ends of the belt; and a belt overlap having a first side and a second side so that at least one of the first side and the second side cover openings formed in at least one of the first end and the second end of the belt, the belt overlap is configured to appear as a mirror image about the vertical axis, and the belt overlap providing a second layer over a first layer of the belt on each side of the vertical axis.

12. The belt and buckle apparatus of claim 11, wherein the buckle is an entirely hidden from view buckle.

13. The belt and buckle apparatus of claim 11, wherein the belt overlap covers the buckle.

14. The belt and buckle apparatus of claim 11, further comprising a slider on the buckle, the slider engaging at least one opening formed in the first end of the belt to adjustably attach the buckle to the first end of the belt.

15. The belt and buckle apparatus of claim 11, further comprising a tongue on the buckle, the tongue engaging an opening formed in the second end of the belt to removably attach the buckle to the second end of the belt.

16. An apparel belt and buckle apparatus, comprising:

a belt having a first end and a second end, the belt defining a vertical axis through a front portion of the belt;

a buckle adjustably attached to one of the two ends of the belt, the buckle removably attaching to at least another of the two ends of the belt;

a slider on the buckle, the slider engaging an opening formed in the first end of the belt to adjustably attach the buckle to the first end of the belt;

a tongue on the buckle, the tongue engaging an opening formed in the second end of the belt to removably attach the buckle to the second end of the belt; and a belt overlap having a first side and a second side so that at least one of the first side and the second side cover openings formed in at least one of the first end and the second end of the belt, the belt overlap is configured to appear as a mirror image about the vertical axis, and the belt overlap providing a second layer over a first layer of the belt on each side of the vertical axis; and a right-side free end and a left-side free end of the belt overlap, both the right-side free end and the left-side free end hanging free when the first end and the second end of the belt are connected to each other.

17. The belt and buckle apparatus of claim 16, further comprising connectors to link the slider to the buckle.

18. The belt and buckle apparatus of claim 16, wherein each of two opposite sides of the buckle attach to the first end and the second end of the belt with separate sliders.

19. The belt and buckle apparatus of claim 16, further comprising a hinged slider clip.

20. The belt and buckle apparatus of claim 16, further comprising an adjustable keeper.

* * * * *